US006076290A

United States Patent [19]

Seitle et al.

[11] Patent Number: 6,076,290

[45] Date of Patent: Jun. 20, 2000

[54] DIRECTION CONTROL SYSTEM FOR A SLURRY WALL DEVICE

[75] Inventors: Ignaz Seitle, Karlshuld; Maximilian Arzberger, Igenhausen, both of Germany

[73] Assignee: Bauer Spezialtiefbau GmbH, Schrobenhausen, Germany

[21] Appl. No.: 09/156,879

[22] Filed: Sep. 18, 1998

[30] Foreign Application Priority Data

Sep. 18, 1997 [DE] Germany ..... 197 41 170
Sep. 30, 1997 [DE] Germany ..... 197 43 308

[51] Int. Cl.[7] ..... E02D 5/18

[52] U.S. Cl. ..... 37/398; 37/348; 405/267

[58] Field of Search ..... 37/347, 348, 398; 405/267, 240, 237, 232, 266

[56] References Cited

U.S. PATENT DOCUMENTS 4,249,836 2/1981 Schmednecht ..... 405/267
4,526,413 7/1985 Williams ..... 37/348 X
4,877,357 10/1989 Verstraeten ..... 405/267
5,707,182 1/1998 Leffer ..... 405/267

FOREIGN PATENT DOCUMENTS 412 477 B1 2/1991 European Pat. Off. .
3602 387 C1 6/1987 Germany .
41 19 212 C2 12/1992 Germany .
3805 868 A1 9/1993 Germany .
56-0077422 6/1981 Japan .

*Primary Examiner*—Robert E. Pezzuto
*Attorney, Agent, or Firm*—Nixon Peabody LLP; Donald R. Studebaker

[57] ABSTRACT

On a slurry wall device having a cable mounting, on which is attached a supporting cable for guiding the slurry wall device, is provided an adjusting device, with which a supporting cable contact point can be laterally displaced, so that the slurry wall device can be controlled with respect to its deflection in the trench. This permits the orientation of the slurry wall device and consequently its contact angle ofthe bore hole bottom to be controlled by a particularly simple device. It is also easily possible to retrofit a slurry wall device with such an adjusting device.

13 Claims, 6 Drawing Sheets

DIRECTION CONTROL SYSTEM FOR A SLURRY WALL DEVICE

TECHNICAL FIELD OF THE INVENTION

The invention relates to a slurry wall device such as a slurry wall grab or a slurry wall cutter; having a cable mounting, to which is attached a supporting cable for holding and guiding the slurry wall device. Particularly, the present invention is directed to, and a device for the direction control of the slurry wall device.

BACKGROUND OF THE INVENTION

Slurry wall grabs or cutters produce narrow trenches or open cuts with a depth up to 80 m. As a function of the particular use, the trench width is typically 300 mm to 1500 mm. The slurry wall means is lowered by device of a supporting cable into the trench produced and oriented and positionally stabilized by a lateral guide frame. The dimensions of the guide frame roughly correspond to the cross-section of an opened shovel or scoop of a slurry wall grab or the cutting wheel arrangement of a slurry wall cutter.

Normally precisely vertical trenches can be produced. However, there is sometimes a need to diverge slightly from the vertical in order to meet special demands. It is therefore important in such cases that the slurry wall device can be directionally controlled to a certain extent, so as to be able to perform direction corrections or changes. Such a control can be initiated in the case of a grab by a pivoting of the grab spades. For this purpose it is necessary to turn the bearing block with the grab spades mounted thereon with respect to the overall structure of the slurry wall grab. As a result, a direction change can be obtained and also a possible divergence from the given, vertical trench orientation can be corrected. Such a device is set forth in either JP-A-560 077 423 or DE-C-3602 387.

Another direction control possibility exists by constructing parts of the guide frame in a displaceable or slidable manner, so that by a planned displacement or deflection of parts of the guide frame and the interaction thereof with the walls of the trench, there is a planned tilting of the slurry wall means. The use of these so-called control flaps is set forth in either DE-A-38 05 868 or DE-C-41 19 212.

These two possibilities for the direction control of a slurry wall grab are further set forth in EP 412 477 B1.

SUMMARY OF THE INVENTION

On the basis of the aforementioned slurry wall device, the primary object of the present invention is to provide a slurry wall device, which is directionally controllable in highly precise manner using simple means.

According to the fundamental idea of the present invention, a slurry wall device with a cable mounting, to which is attached a supporting cable for the guidance of the slurry wall means, and a device for the direction control of the slurry wall means is so constructed to include an adjusting device, which laterally displaces an attachment or contact point of the supporting cable, so that the slurry wall device is controllable with respect to its vertical orientation. The slurry wall device has a cable mounting to which the supporting cable is fixed. Usually a cable mounting support directly forms the contact point of the supporting cable, which is vital for the action of the upwardly directed force of the supporting cable. However, the supporting cable can also be guided or deflected at other points linked with the slurry wall device, so that they form the contact point of the cable mounting. Through the lateral displacement of the contact point transversely to the vertical, the slurry wall device is tilted, because the centre of gravity always remains vertically below a crane fastening of the cable outside the trench.

The lateral or vertical displacement of the contact point of the supporting cable is to be understood in such a way that the supporting cable normally contacts in the geometrical centre of the slurry wall device on which is also located the centre of gravity of the slurry wall device and is displaced out of this axial alignment. The connection of the contact point of the supporting cable to the centre of gravity of the slurry wall device on the one hand and the geometrical axis on the other form an angle differing from zero. As a result of this displacement of the supporting cable contact point an eccentric suspension and consequently a sloping position of the slurry wall device are obtained and consequently the latter is in contact with the bore hole bottom in this deflected position.

Such a slurry wall device control can be implemented at low cost and permits a particularly precise control, which renders unnecessary interaction with the walls of the trench produced. In addition, existing slurry wall device can be relatively easily equipped with the control system according to the present invention.

The adjusting device is preferably positioned on the upper end region of the slurry wall device. As a result, during maintenance work, the latter is particularly easily accessible and can also be easily fitted in the case of existing equipment. The supporting cable is preferably also fixed in the upper end region of the slurry wall device, although it is also possible to place the cable mounting within the slurry wall device and to lead the supporting cable upwards out of the latter. However, it is preferable to position the cable mounting above the centre of gravity of the slurry wall device, because this ensures a stable guidance with the supporting cable.

In the case of the slurry wall device, which can be a slurry wall grab or a slurry wall cutter, the possibility exists of directly placing and displacing the cable mounting in the adjusting device. It is also possible to position the cable mounting on the slurry wall device below the adjusting device and for the supporting cable to pass through and be displaced in the adjusting device, so that again the supporting cable contact point is displaced and the slurry wall device consequently changes its vertical position.

In the case of the first-mentioned possibility, the cable mounting is placed on a block displaceable in a rail in the X-direction, with the rail being displaceable in the Y-direction. Thus, in a simple manner, a cable mounting displaceable in two directions can be implemented. The second fundamental possibility can be implemented in such a way that two parallel rods being provided, between which the supporting cable is guided and which are jointly displaceable in the X-direction. For this purpose, two further, parallel rods are provided, which are positioned perpendicular to the two other, parallel rods and which are displaceable in the Y-direction. The supporting cable passes between the parallel rods and is consequently fixed in both the X and Y-direction. As a result of the displacement of the parallel rods, there is also a displacement of the contact point of the supporting cable passing through the adjusting device, the supporting cable being fixed to the cable mounting positioned below the adjusting device.

The adjusting device is preferably manually operated if the device is positioned outside the trench. The manual displacement can be brought about by a worm gear or a lever mechanism. In another embodiment, the adjusting device is mechanically operated and use is preferably made of a hydraulic or electrohydraulic drive or electric displacement device, such as hydraulic cylinders. Preferably there is a remote control for the operation of the adjusting device. It is also advantageous to combine the drive device, so that the adjusting device can be operated either manually or mechanically.

It is to be noticed that the adjusting device is in all cases designed for a displacement of the supporting cable contact point in both the X and Y-directions, based on a plane running perpendicular to the supporting cable.

According to a preferred embodiment of the present invention, the adjusting device is constructed in such a way that when the adjusting device is in the neutral position, the supporting cable contact point is in the geometrical center axis of the slurry wall device. According to a preferred development, the adjusting device has a control mechanism, which measures the vertical orientation of the slurry wall device and displaces the cable mounting with the adjusting device in such a way that a predetermined, vertical orientation of the slurry wall device is set. This ensures a permanent, precise, vertical orientation of the slurry wall device.

The slurry wall device is preferably designed in such a way that the centre of gravity is located directly below the geometrical centre of the slurry wall device. This is favourable, because the closer the centre of gravity to the adjusting device the greater the directional deflection of the slurry wall device, because then for a constant deflection of the supporting cable the angle between the deflected supporting cable and the centre of gravity on the one hand and the geometrical axis on the other becomes larger. It is also important for the stability of the slurry wall device that the centre of gravity Ls below the geometrical centre, i.e. below the centre of buoyancy, because only in this way is a stable standing position of the slurry wall device achieved. Thus, if the centre of gravity of the slurry wall device is directly below the geometrical centre thereof, maximum account is taken of both requirements. For the displacement of the centre of gravity, e.g. the lateral guide frame can be made correspondingly solid or hollow. Preferably, the slurry wall device guide frame is constructed in hydraulically adjustable manner and has a control device, which readjusts and corrects the setting of the guide frame as a function of the deflection of the complete slurry wall device, so that even when the slurry wall device is sloping there is no tilting and hooking to the trench walls.

The present invention creates a controllable slurry wall device, which has a particularly simple construction and whose manufacture is inexpensive, due to the limited constructional costs. Retrofitting of existing slurry wall means with the adjusting device according to the present invention is easily possible.

BRIEF DESCRIPTION OF THE DRAWINGS

The invention is described in greater detail hereinafter relative to embodiments and the attached drawings, wherein show.

DETAILED DESCRIPTION OF THE PRESENT INVENTION

Figure 1:
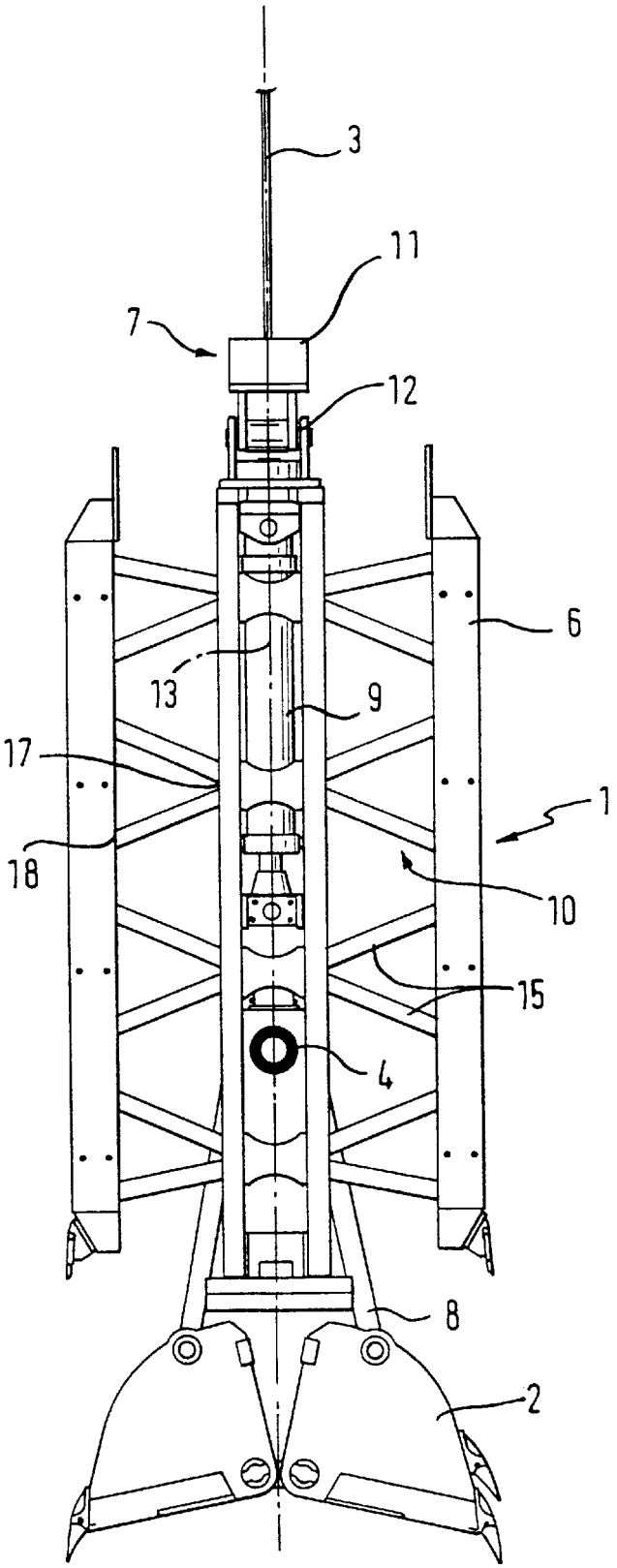
FIG. 1 A front view of a slurry wall grab according to the present invention.
Figure 2:
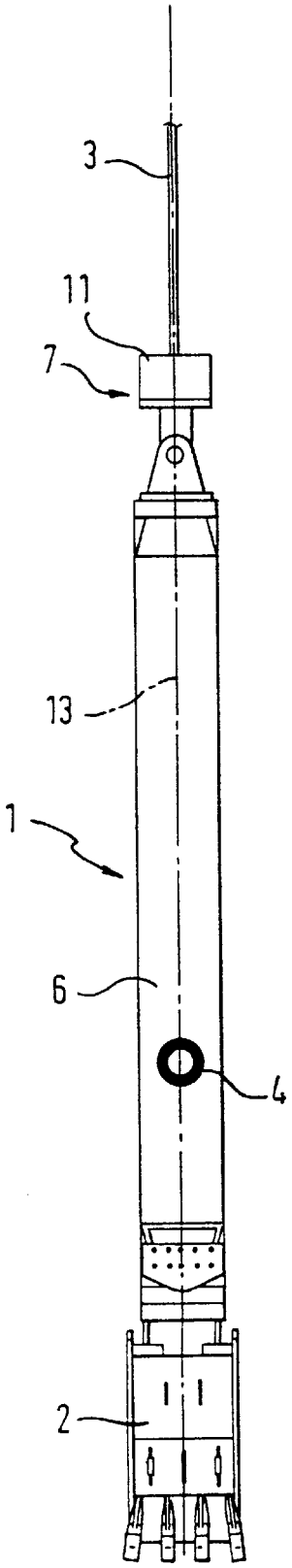
FIG. 2 A side view of the slurry wall grab according to the invention.

FIGS. 1 and 2 show a slurry wall grab in two different side views. The essential element of the slurry wall grab 1 in accordance with the present invention; and after "side views" insert—rotated 90° with respect to one another is the shovel or scoop 2 with which the trench or open cut is dug. The shovel 2 is operated by device of an operating cable from a outside or by device of a push and pull linkage 8 with a hydraulic cylinder 9 located in the slurry wall grab 1. The slurry wall grab 1 has a guide frame 6, whose dimensions roughly correspond to those of the shovel 2 and are in fact somewhat smaller than the dimensions of the shovel 2, in order to prevent tilting in the trench. The guide frame 6 is equipped with a lattice construction 10 in the direction in which the shovel 2 opens and closes, so that in this direction the guide frame corresponds to the width of the opened shovel 2. The width of the guide frame 6 in the other direction is apparent from FIG. 2. The width of the guide frame 6 in the plane shown in FIG. 2 is somewhat less than the width of the shovel 2. The centre of gravity 4 of the slurry wall grab 1 is indicated by a blackened circle. The height of the centre of gravity 4 is also determined by the construction of the guide frame 6, which in portions can be either solid or hollow, in order to displace the height of the centre of gravity 4.

In its upper end region the slurry wall grab 1 has an adjusting device 7, which essentially has an adjusting box 11 and a fastening 12. The fastening 12 serves to produce a detachable, but rigid connection of the adjusting device 7 to the remaining slurry wall grab 1. A supporting cable 3, which guides the slurry wall grab 1 and which is lowered into the trench, runs into the adjusting box 11 of the adjusting device 7. In FIGS. 1 and 2, the supporting cable 3 is fixed and centred in the geometrical centre of the adjusting device 7. Consequently the supporting cable 3 forms an extension of the geometrical axis 13 of the slurry wall grab 1, on which is also located the centre of gravity 4.

Figure 3:
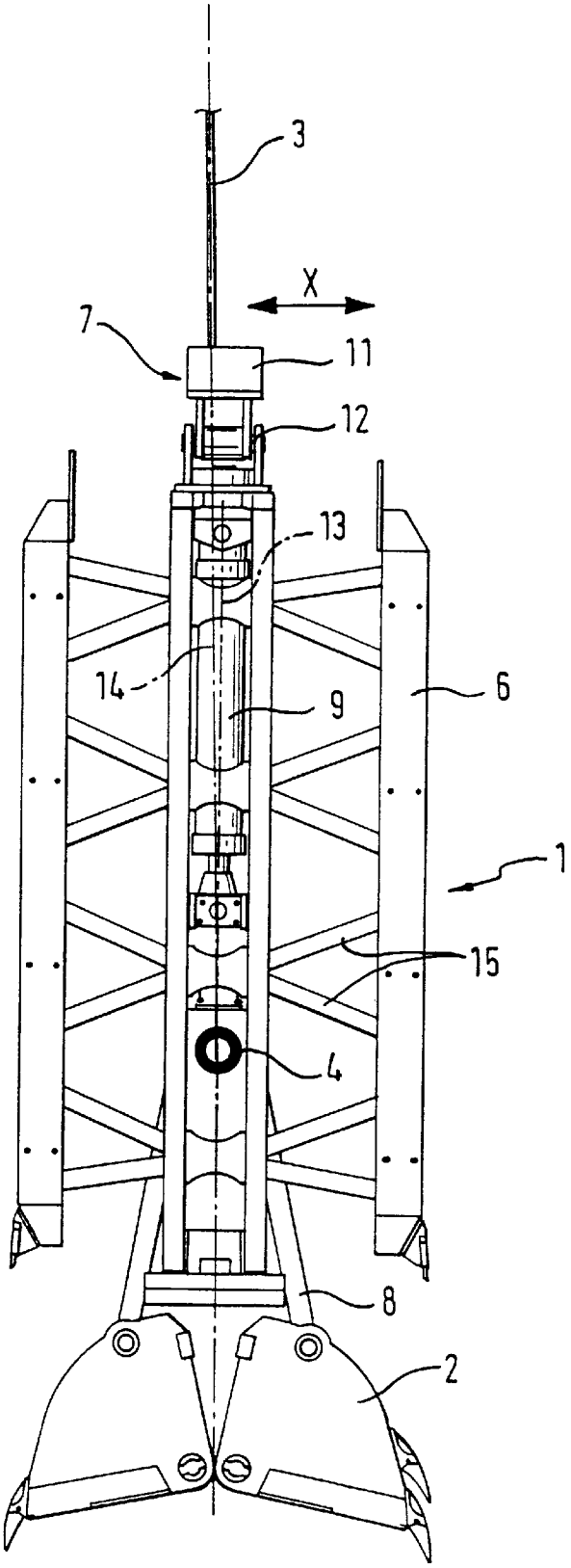
FIG. 3 A front view of a slurry wall grab according to FIG. 1, in which the supporting cable contact point is laterally displaced.
Figure 4:
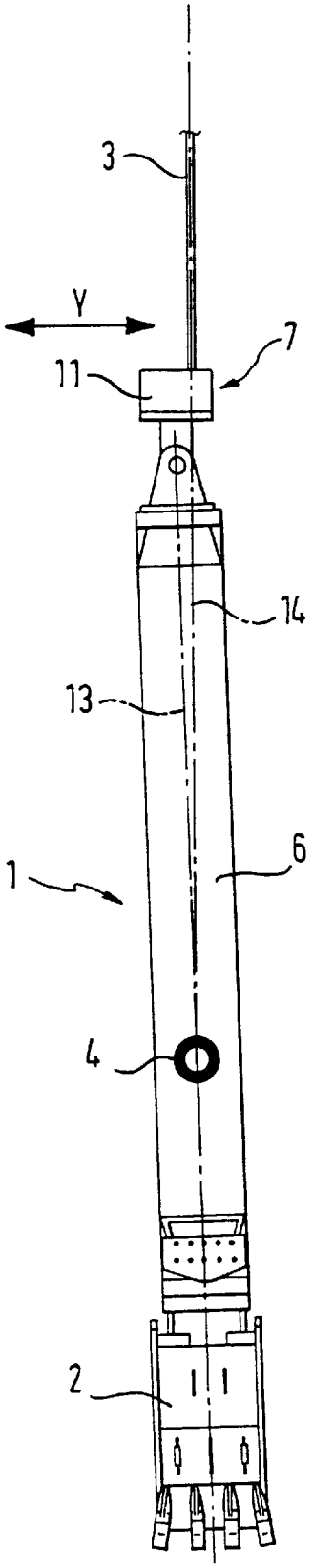
FIG. 4 A side view of a slurry wall grab according to FIG. 2, in which the supporting cable contact point is laterally displaced.

In FIGS. 3 and 4 the contact point of the supporting cable 3 has been displaced out of the geometrical axis 13 of the slurry wall grab 1. Whereas in FIGS. 1 and 2 the slurry wall grab 1 is oriented through the arrangement of the supporting cable 3 in a vertical position, the slurry wall grab 1 in FIGS. 3 and 4 is deflected by the displacement of the suspension point of the supporting cable 3. In FIG. 3 the deflection of the slurry wall grab 1 is represented by the displacement of the supporting cable 3 in the X-direction and in FIG. 4 the deflection of the slurry wall grab 1 is represented by the displacement of the supporting cable 3 in the Y-direction. The deflection results from the angle between the geometrical axis and its intersection with the imaginary line between the centre of gravity 4 of the slurry wall grab 1 and the displaced contact point of the supporting cable 3. This line is designated 14 in FIGS. 3 and 4. It is immediately apparent from this, that for obtaining a greater deflection angle, either the supporting cable 3 is further deflected, i.e. brought into a more eccentric position, or the centre of gravity 4 of the slurry wall grab 1 must be displaced upwards. In other words, it can be said that by a further upwardly positioned centre of gravity 4, there is no need for such a pronounced deflection of the supporting cable 3 in order to obtain the same deflection angle of the slurry wall grab 1. The height of the centre of gravity 4 can be determined to a certain extent during the construction and design of the slurry wall grab 1 and can e.g. be determined by the design of the grab 1 and in particular the construction of the guide frame 6. Thus, the centre of gravity 4 should be in the lower half of the slurry wall grab 1, in order to ensure the stability thereof. It is consequently favourable to design the slurry wall grab 1 in such a way that its centre of gravity 4 is just below the geometrical centre of the slurry wall grab 1. Through the displacement of the supporting cable 3, an eccentric suspension and consequently an Inclined position of the grab are obtained, so that it contacts the bore hole bottom under the same deflection angle. Thus, the bore direction can be changed in planned manner. If necessary, any divergences which occur can be corrected by scraping the bore hole wall and a planned divergence from the vertical can be produced. In order to assist this orientation, it can be advantageous to correspondingly adapt the guide frame. For this purpose, on the struts 15 of the lattice construction 10 are provided joints 17 between the struts 15 and the inner area of the slurry wall grab 1 and joints 18 are also positioned between the struts 15 and the guide frame 6. As a result of the joints 17 and 18, it is possible to pivot the guide frame 6 relative to the remaining slurry wall grab 1 by an angle roughly corresponding to the deflection angle of the overall slurry wall grab 1. In addition, the struts 15 can be hydraulically slid in and out, so that the width of the guide frame 6 can also be modified through the length of the struts 15, so that in the case of a deflection of the slurry wall grab 1 there is an adaptation to the modified bore hole geometry, should this be necessary.

Figure 5:
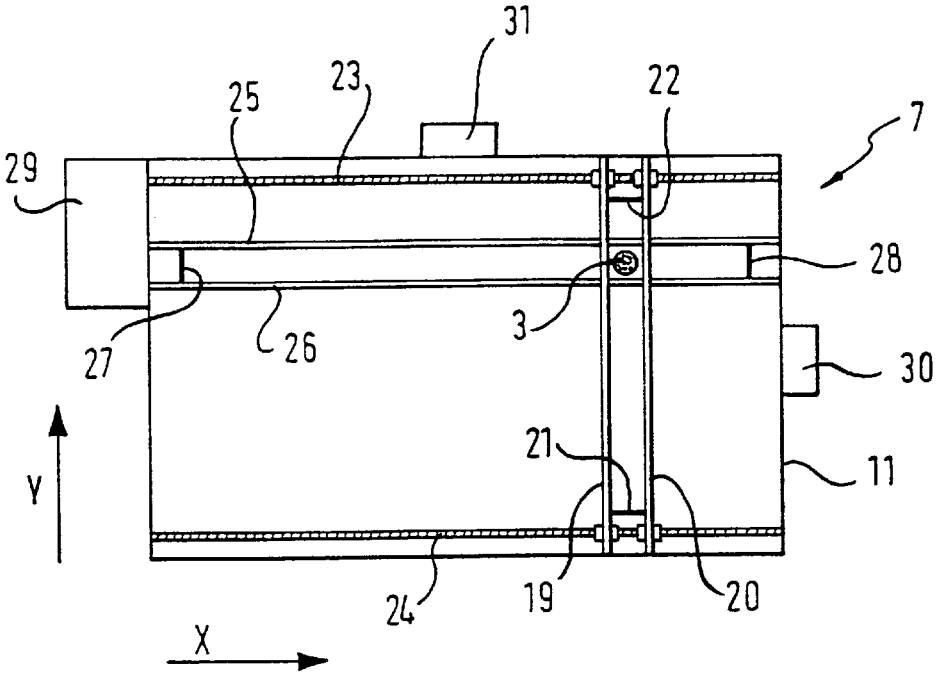
FIG. 5 A plan view of a first embodiment of an adjusting device in accordance with the present invention.
Figure 6:
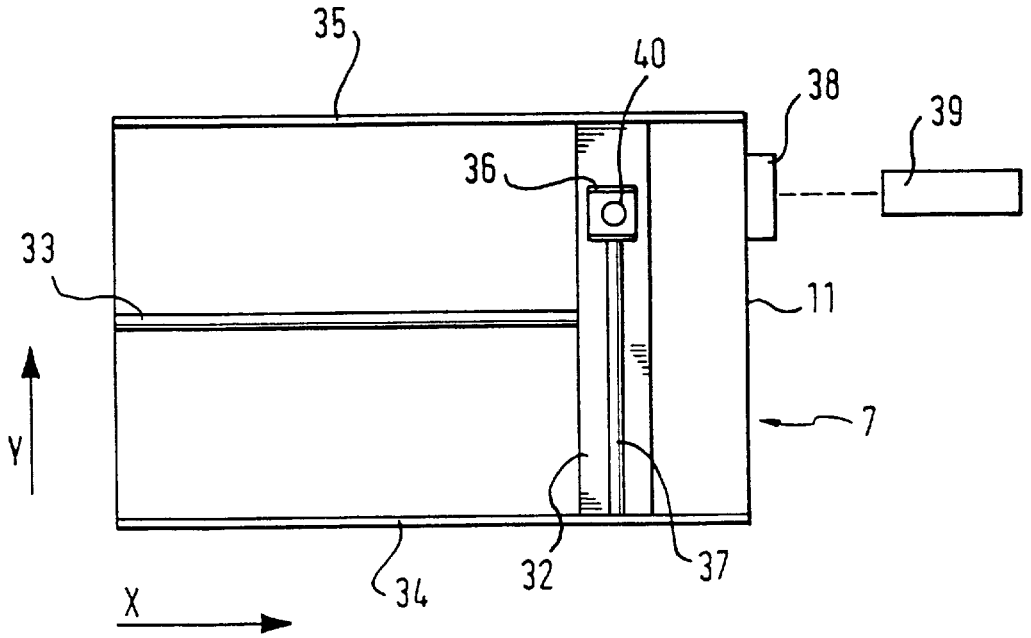
FIG. 6 A plan view of a second embodiment of an adjusting device accordance with the present invention.

FIG. 5 is a plan view of a first embodiment of the adjusting device 7. In this embodiment, the supporting cable 3 passes through the adjusting box 11 and is fixed behind the latter to the slurry wall grab 1. In FIGS. 5 and 6 the adjusting box 11 is rectangular. However, the adjusting box 11 can also be square or have some other configuration. The dimensions of the adjusting box 11 must be such that the necessary deflection of the supporting cable can be achieved within the said box 11. The adjusting box 11 has two parallel rods 19 and 20 displaceable in the X-direction and between which is passed the supporting cable 3. The rods 19 and 20 are round, so as to keep friction with the supporting cable to the minimum. The spacing of the two rods 19 and 20 is somewhat larger than the cross-section of the supporting cable 3. The two rods 19 and 20 are also reinforced by cross-bracing device 21, 22, which are positioned close to the edge of the adjusting box 11. The parallel rods 19 and 20 are displaced by a bilateral worm gear 23, 24. However, it is also possible to use a hydraulic device. The displacement in the Y-direction takes place in a comparable manner by two parallel rods 25, 26, which are equipped with braces 27, 28, positioned close to the edge of the adjusting box 11. The supporting cable 3 is also passed between these two rods 25, 26, so that the supporting cable 3 is fixed in a small area by the two crossing rod arrangements. Through a displacement of the parallel rods 19, 20 and the parallel rods 25, 26, it is possible to randomly modify the contact point of the supporting cable 3 on the slurry wall grab 1, so that the effect of the deflection of the grab 1 described in conjunction with FIGS. 3 and 4 is achieved. The parallel rods 25, 26 are also displaceable by a worm gear, which is not shown in the drawings. The worm gear can be operated either manually or by a motor. There is also a control device 29 on the adjusting box 11, with which are associated two sensors 30 and 31, which measure the orientation of the slurry wall grab 1 in the X and Y-directions. The control device 29 can be provided beforehand with the desired deflection of the slurry wall grab 1, so that the control device 29 controls the displacement of the parallel rods 19, 20 and 25, 26 in such a way that the supporting cable 3 is always so displaced that the slurry wall grab 1 is brought precisely into the desired deflection, which is measured by the sensors 30 and 31 and the results determined by the latter are supplied to the control device 29. The control device 29 can also be used with great advantage for a precise, vertical orientation of the slurry wall grab!

A second embodiment of an adjusting device according to the present invention is shown in FIG. 6. Unlike in the embodiment of FIG. 5, here the cable mounting 40 of the supporting cable 3 is directly fixed in the adjusting box 11. In this embodiment a rail 32 displaceable in the X-direction is provided and which is displaced by device of a hydraulic cylinder 33. The rail 32 runs in guides 34, 35, which are fitted to the sides of the adjusting box 11. The rail 32 has a fastening block 36, to which the supporting cable 3 is fastened. The fastening block 36 is displaceable in the Y-direction on the rail 32 by device of a hydraulic cylinder 37. Also in this embodiment of the adjusting device, it is possible to use with considerable advantage the control device with the sensors 30 and 31 shown in FIG. 5. On the adjusting box 11 is also provided a receiver 38, which is electrically connected to the operating device with which are displaced the cable mounting 40, which in this case also forms the contact point of the supporting cable 3, i.e. in this case with the hydraulic cylinders 33 and 37. The receiver 38 can be controlled by a remote 39, so that it is also possible to deflect the slurry wall grab 1, if the latter is located during operation in the trench.

In this embodiment it is also possible to advantageously use a circular adjusting box 11, in which the rail 32 is turned on a circular guide in the adjusting box and a displaceable bearing block is positioned on the rotary rail.

In the case of so-called two-cable grabs with a supporting cable 3 and an operating cable not shown, the adjusting device 11 is rigidly connected to the guide frame 6. As stated hereinbefore, the supporting cable 3 is connected to the adjusting device 11. The operating cable is guided by a passage or link. The supporting cable suspension point and the link are interconnected, so that they can be jointly displaced through the adjusting device 11.

Figure 7:
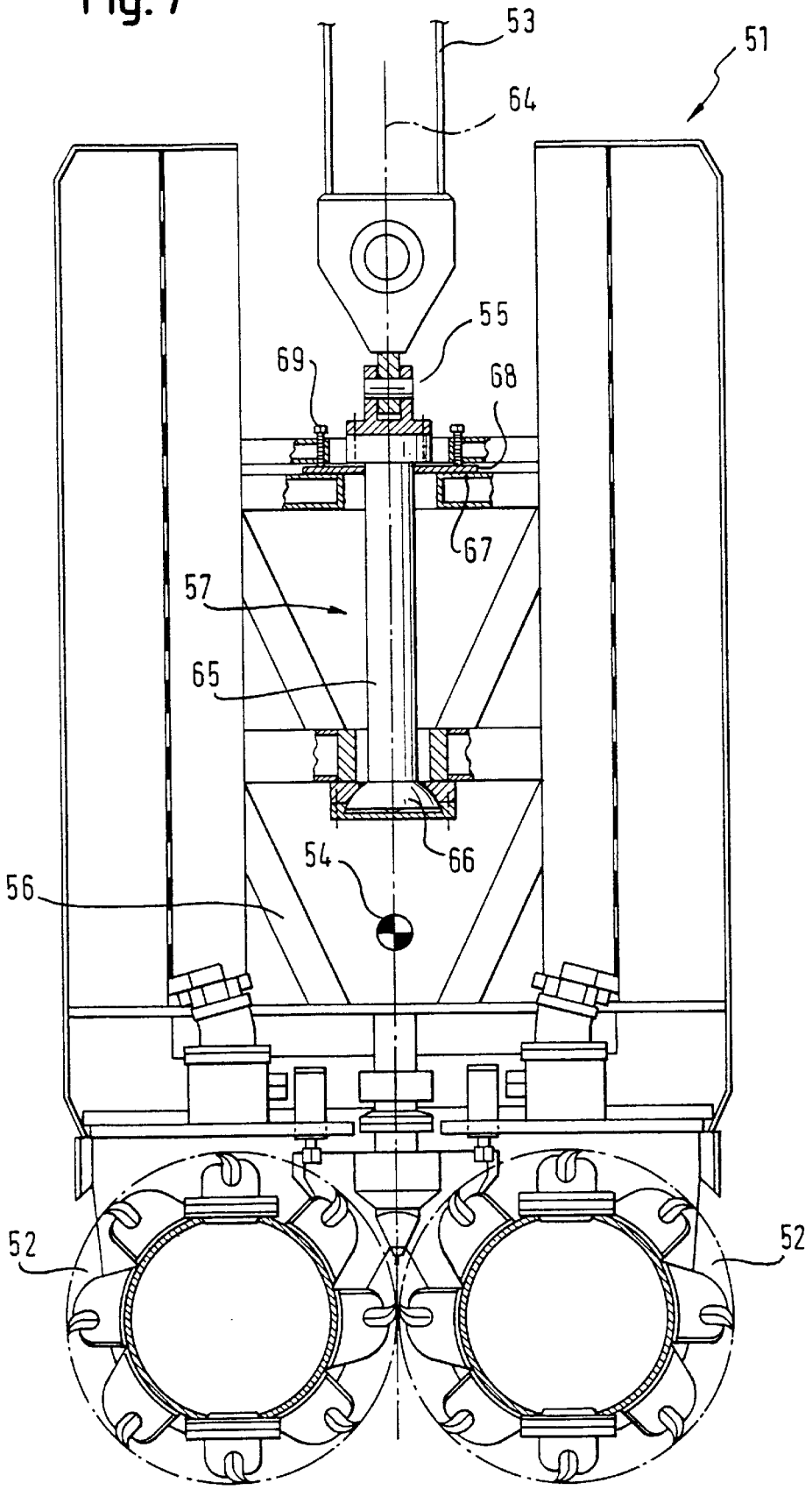
FIG. 7 A front view with partial elevation of a slurry wall cutter according to the present invention.
Figure 8:
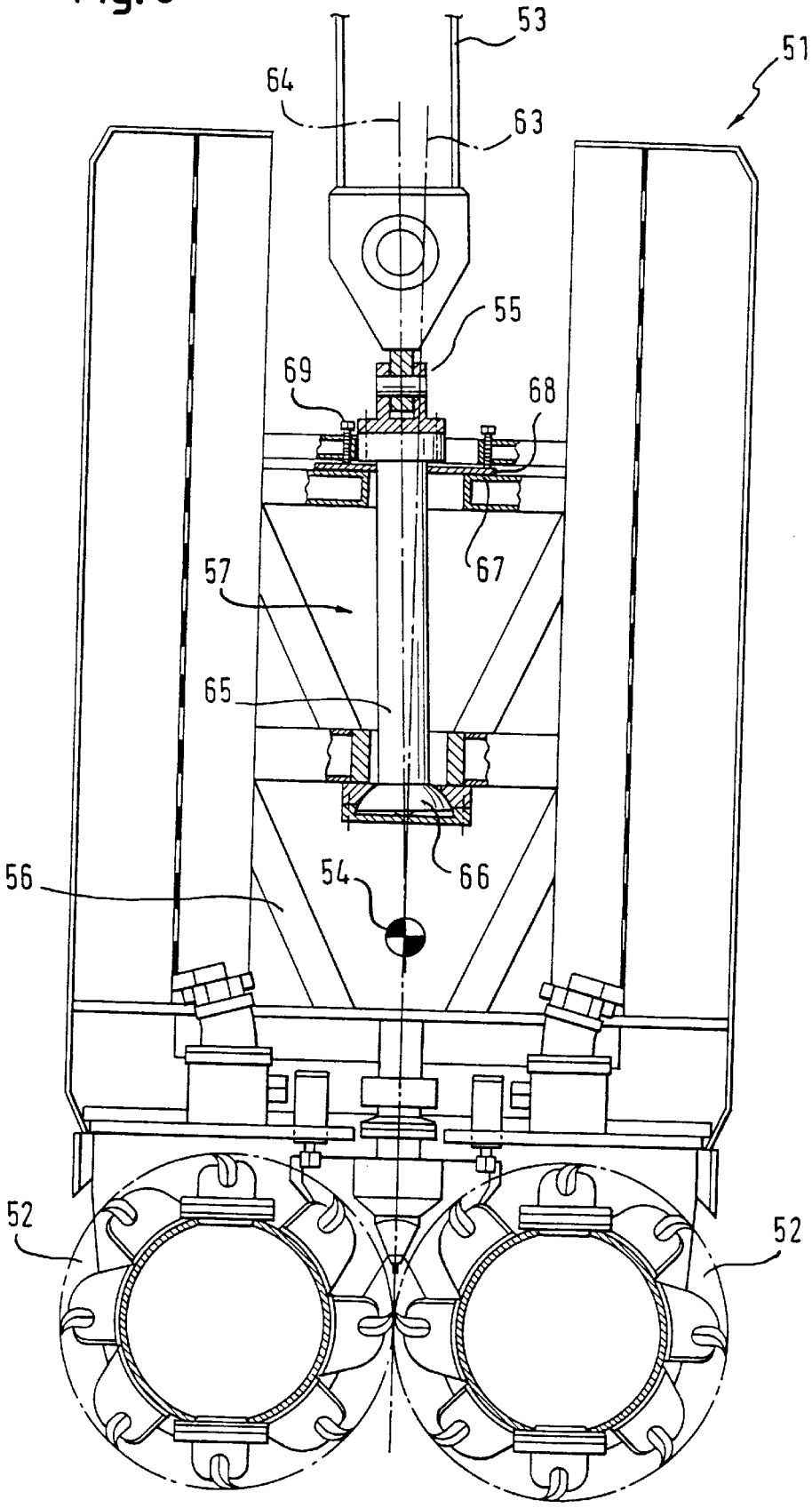
FIG. 8 A view of the slurry wall cutter according to FIG. 7 in a tilted position.

FIGS. 7 and 8 show a slurry wall cutter 51 according to the present invention with a guide frame 56 and cutting wheels 52. The guide frame 56 is suspended on a supporting cable 53 by device of a gimbal suspension 55. In a normal position, a centre of gravity 54 and the centre axis of the gimbal suspension 55 and a not shown holding point, e.g. one end of a crane jib, are jointly located in the vertical line 64, so that the latter coincides with a geometrical axis 63 of the slurry wall cutter 51.

This slurry wall cutter 51 has a manually modifiable adjusting device 57, which comprises a substantially vertically directed support 65, which at its lower end is mounted in deflectable manner on the guide frame 56 by device of a spherical joint 66. At its upper end, the support 65 is connected to the gimbal suspension 55 for the supporting cable 53. The support 65 penetrates a substantially horizontally directed guide plate 68, which is placed on a bearing plate 67. By device of a clamping device 69, which can incorporate threaded bolts, the position of the guide plate and consequently the support 65 with respect to the bearing plate 67 rigidly fitted to the guide frame 56 can be manually fixed.

Through a horizontal displacement of the guide plate 68, as shown in FIG. 8, the support 65 and consequently the gimbal suspension 55 are displaced from the geometrical axis 63 of the slurry wall cutter 51. This brings about a deflection of the geometrical axis 63 from the vertical.

Figure 9:
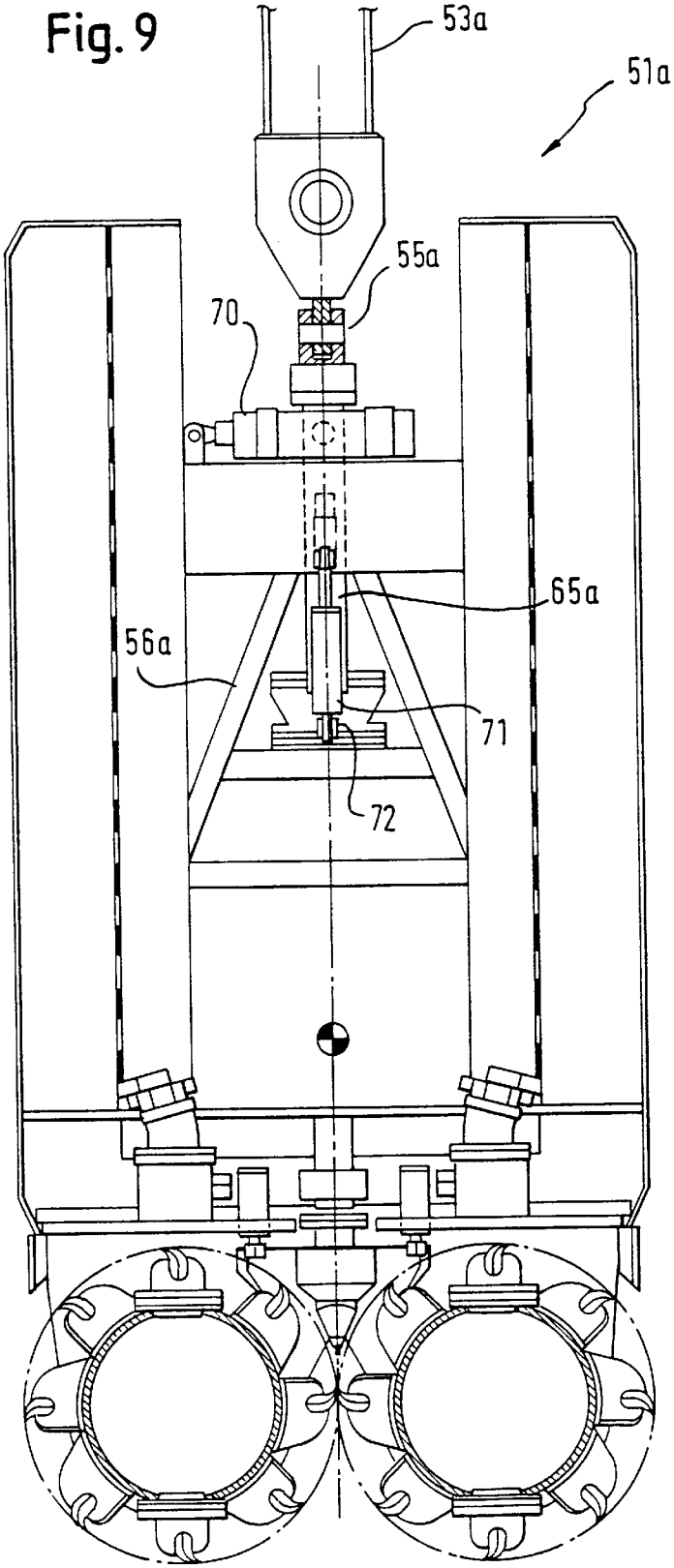
FIG. 9 A front view of another slurry wall cutter according to the present invention, with a lever mechanism.

FIG. 9 shows a similarly constructed, further slurry wall cutter 51*a* with a guide frame 56*a* and a support 65*a*, pivotably mounted thereon. The gimbal suspension 55*a* for a supporting cable 53*a* is fitted to the upper end of the support 65*a*.

For a deflection of the slurry wall cutter 51*a* to the left and right in the lane of the drawing, a first hydraulic cylinder 70 is provided, which as directed substantially horizontally. The first hydraulic cylinder 70 is on the one hand pivotably connected to the guide frame 56a and on the other to the support 65*a*.

Figures 9A, 9B:
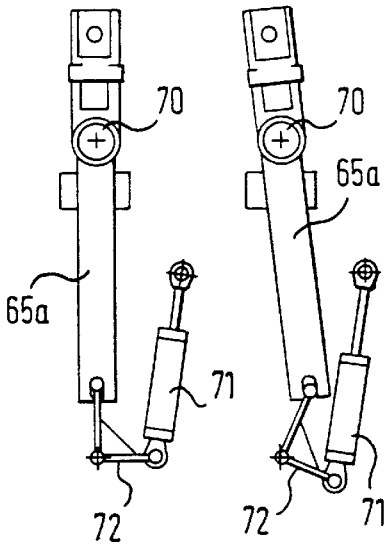
FIG. 9*a* A detail of the lever mechanism of FIG. 9 in a neutral position.
FIG. 9*b* A detail of the lever mechanism of FIG. 9 in a tilted position.

For a pivoting of the slurry wall cutter 51a vertically with respect to the plane of the drawing, a second hydraulic cylinder 71 is provided, which is coupled by device of a lever mechanism having a rectangular lever 72 to the lower end of the support 65*a*. As can be gathered from FIGS. 9*a* and 9*b*, by device of suitable swivel joints, a lifting motion of the second hydraulic cylinder 71 is transformed into a pivoting of the support 65*a*.

It is clear from what has been stated hereinbefore, that an essential advantage of the invention is constituted by the limited mechanical costs for implementing a control of a slurry wall device. This also offers the possibility of a simple reequipping of existing slurry wall device.

What is claimed is:

1. Slurry wall device for forming a trench comprising:

a main frame, a cable mounting on said main frame for attachment of a supporting cable at a supporting cable contact point for holding and guiding the slurry wall device, a direction control device for controlling a direction of the slurry wall device, and an adjusting device for displacing said supporting cable contact point of said cable mounting relative to said elongated direction of the slurry wall device thereby controlling an orientation of the slurry wall device.

2. Slurry wall device according to claim 1, wherein the adjusting device is located in an upper end region of the slurry wall device and that the supporting cable is fixed to the upper end region above a centre of gravity of the slurry wall device.

3. Slurry wall device according to claim 1, wherein said slurry wall device is one of a slurry wall grab and a slurry wall cutter.

4. Slurry wall device according to claim 1, wherein said cable mounting for the supporting cable and a guide for an operating cable are displaceable by the adjusting device.

5. Slurry wall device according to claim 4, wherein said cable mounting is placed on a block displaceable on a rail in one direction and said rail is displaceable in a direction perpendicular to the block.

6. Slurry wall device according to claim 1, wherein said cable mounting is positioned below said adjusting device.

7. Slurry wall device according to claim 6, wherein said adjusting means includes two parallel rods, between which said supporting cable is guided and displaceable in a first direction and that said adjusting device includes two further parallel rods, between which said supporting cable is guided, said further parallel rods being positioned perpendicular to the two other parallel rods and are displaceable in a second direction.

8. Slurry wall device according to claim 1, wherein said adjusting device is manually operable.

9. Slurry wall device according to claim 1, wherein said adjusting device is mechanically operated and said adjusting device includes hydraulically operated device for displacing said supporting cable.

10. Slurry wall device according to claim 1, wherein a remote control device is provided for remotely controlling said adjusting device.

11. Slurry wall device according to claim 1, wherein a neutral position of said adjusting device is provided when a contact point of said supporting cable is located on a vertical connecting line between a centre of gravity of the slurry wall device and a suspension point of a crane positioned outside the trench to be made.

12. Slurry wall device according to claim 1, wherein said adjusting device includes a control device for setting an orientation of the slurry wall device in accordance with a predetermined orientation, said control device including sensors for measuring an orientation of the slurry wall device in X and Y-directions, said sensors being electrically connected to said control device.

13. Slurry wall device according to claim 1, wherein the centre of gravity of the slurry wall device is located directly below the geometrical centre of the slurry wall device.

* * * * *